US006254215B1

(12) United States Patent
Hiroki et al.

(10) Patent No.: US 6,254,215 B1
(45) **Date of Patent: *Jul. 3, 2001**

(54) INK JET PRINTING HEAD AND METHOD FOR PRODUCING THE SAME

(75) Inventors: Tomoyuki Hiroki, Zama; Miki Ito, Yokohama; Toshio Kashino, Chigasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/344,113

(22) Filed: Jun. 24, 1999

(30) Foreign Application Priority Data

Jun. 26, 1998 (JP) ..... 10-180969
Jun. 21, 1999 (JP) ..... 11-174423

(51) Int. Cl.[7] ..... B41J 2/015; B41J 2/05
(52) U.S. Cl. ..... 347/20; 347/63
(58) Field of Search ..... 347/20, 63, 65, 347/67, 40

(56) References Cited

U.S. PATENT DOCUMENTS

| | | | | |
|---|---|---|---|---|
| 4,698,645 | * | 10/1987 | Inamoto | 347/65 |
| 4,994,825 | | 2/1991 | Saito et al. | 347/65 |
| 5,017,947 | * | 5/1991 | Masuda | 347/65 |
| 5,096,535 | | 3/1992 | Hawkins et al. | 156/633 |
| 5,132,707 | * | 7/1992 | O'Neill | 347/65 |
| 5,208,604 | | 5/1993 | Watanabe et al. | 347/47 |
| 5,389,957 | | 2/1995 | Kimura et al. | 347/20 |
| 5,748,213 | | 5/1998 | Karita et al. | 347/63 |
| 5,826,333 | | 10/1998 | Iketani et al. | 29/890.1 |
| 5,933,163 | | 5/1999 | Koizumi et al. | 347/52 |

FOREIGN PATENT DOCUMENTS

| | | |
|---|---|---|
| 60-206657 | 10/1985 | (JP) . |
| 02187351 | 7/1990 | (JP) . |
| 95/04658 | 2/1995 | (WO) . |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet printing head in which nozzles and a liquid chamber are formed by adhering a first substrate on which plural walls are formed and a second substrate in mutually opposed manner. The plural walls formed on the first substrate and to be adhered to the second substrate are arranged by the combination of walls of a substantially same width, and the walls are provided with an adhesive layer on the adhering faces thereof and integrally adhered to the second substrate.

28 Claims, 7 Drawing Sheets

INK JET PRINTING HEAD AND METHOD FOR PRODUCING THE SAME

BACKGROUND OF THE INVENTION

1. Field of the Invention

The present invention relates to an ink jet printing head adapted for use in an ink jet printer and a method for producing the same, and more particularly to an ink jet printing head in which, in forming nozzles and liquid chamber, the frame of the liquid chamber is constituted by the combination of walls having a width substantially equal to that of the nozzle wall, thereby improving adhesion of a heater board and a top plate and also improving the stability of manufacture, and a method for producing such ink jet printing head.

2. Related Background Art

For use in the ink jet printing head there have been proposed nozzles of various shapes, one of which will be explained with reference to FIG. 6.

Referring to FIG. 6, a top plate 101 is formed from a silicon wafer which is cut and polished in such a manner that the upper face is constituted by the (110) crystalline plane. There are also shown a penetrating hole 102 constituting a liquid chamber or an ink reservoir, and a groove 103 for an ink discharging nozzle.

A silicon chip 108 is provided with a plurality of heat generating members (heaters) 109 and will be hereinafter called a heater board. The top plate 101 and the heater board 108 are adhered in a direction shown in FIG. 6 to form oblong nozzles between nozzles 103 and the surface of the heater board 108. In such adhering operation, the positions of both components are precisely adjusted in such a manner that a heater 109 is contained in each nozzle. Ink is supplied from an unrepresented ink tank, then guided to an ink liquid chamber 102 and reaches the interior of the nozzles 103. The heater board 108 is controlled by an unrepresented control circuit and each heater 109 is energized according to the print data. The above-mentioned control circuit may be provided on the heater board or formed on another substrate, and will not be explained further as it is not related to the principle of the present invention.

The heater 109 energized according to the print data generates heat, thereby heating the ink in the corresponding nozzle. The heated ink boils above a certain critical temperature, thus generating a bubble. The generated bubble grows within a short time of several microseconds and gives an impact force to the ink, whereby a part of the ink is strongly pushed out and lands on a printing medium such as paper. A printed image is obtained by repeating this process.

In the following there will be explained the method of producing the top plate, with reference to FIGS. 7A to 7H. In these drawings, the views at the right-hand side are those of the top plate 101 seen from the lower side (nozzle side) while those at the left-hand side are cross-sectional views of the top plate cut along a plane in the discharging direction.

FIG. 7A illustrates a silicon wafer. FIG. 7B shows the formation of an oxide film. FIG. 7C shows patterning of $SiO_2$. FIG. 7D shows formation of a SiN film. FIG. 7E shows the patterning of SiN. FIG. 7F shows anisotropic etching of Si, wherein a numeral 102 indicates a liquid chamber. FIG. 7G shows elimination of SiN. FIG. 7H shows anisotropic etching of Si, wherein a numeral 103 indicates a nozzle.

FIG. 7A shows a silicon (Si) wafer 105 used as the material for forming the nozzle members, having a crystalline orientation <110> on the surface and <111> in the longitudinal direction of the nozzle. Both sides of the silicon wafer 105 are subjected to the formation of a thin silicon dioxide film 106 of a thickness of about 1 $\mu$m as shown in FIG. 7B, by thermal oxidation or CVD (chemical vapor deposition). The silicon dioxide layer 106 serves as a mask layer in anisotropic etching of silicon. Then, with the ordinary photolithographic process, the silicon dioxide layer 106 is patterned into the shape of nozzles and liquid chamber on one side (lower face in the illustration) and into the shape of the liquid chamber on the other side (FIG. 7C). Then, on the nozzle forming side, a silicon nitride layer 107 is formed for example by CVD (FIG. 7D) and is patterned into the shape of the liquid chamber (FIG. 7E).

The wafer is then subjected to anisotropic wet etching by immersion in etching liquid such as 22% solution of TMAH (tetramethylammonium hydride) whereby the etching proceeds in exposed areas of silicon on both sides of the wafer, namely according to the shape of the liquid chamber and the etched portions from both sides are eventually connected to form penetrating holes. Then the silicon nitride layer on the nozzle face is eliminated by etching (FIG. 7G) to expose the nozzle pattern formed in the silicon dioxide layer 106 in the step shown in FIG. 7C, and anisotropic etching is executed again with TMAH whereby a portion corresponding to the nozzle is etched. In this operation, the liquid chamber etched in the step shown in FIG. 7F is also further etched, but the shape of the liquid chamber is little affected because the etching time for the nozzle is shorter than that for the liquid chamber. Otherwise it is also possible to shorten the etching time for the liquid chamber in consideration of the etching time required for nozzle etching, thereby eventually obtaining the liquid chamber of the desired shape.

However, with the anisotropic etching of the present invention, there can be obtained a nozzle with a rectangular cross section because the <111> plane perpendicular to the wafer surface is present in the ink discharging direction, but, in the longitudinal direction of the nozzle, there is no crystalline plane capable of stopping the etching, so that the wall between the nozzles is overetched in the longitudinal direction to form an acute angle shape. Consequently, in such overetched portion, there inevitably remains the thin silicon dioxide film constituting the mask layer. Such silicon dioxide film alone is removed, without damaging silicon, by blowing pressurized air, eventually containing water, to the wafer. For removing the film of about 1 $\mu$m by blowing water with pressurized air, there is only required a pressure of 1 to 20 kgf/cm$^2$. Otherwise the entire silicon dioxide film may be removed by wet etching employing the mixture of ammonium fluoride and hydrofluoric acid.

The top plate 108 prepared by the above-described process is shown in FIG. 8. In the patterning process for forming the liquid chamber, the both surfaces of the top plate chip are formed in similar shapes, but the pattern at the ink supply side, at the upper surface in FIG. 6, may be made smaller at such a level that the penetrating hole is formed by anisotropic etching. In fact a pattern smaller than at the nozzle side is preferred in order to ensure the connection with the unrepresented ink supply member or the strength of the wafer in forming the top plate.

As explained in the foregoing, anisotropic etching of silicon can be utilized in forming the structure of the top plate, providing high mass producibility since the top plate can be prepared in the state of a wafer. Also the nozzle preparation by photolithographic technology allows to obtain nozzles of a high density with a high precision.

However, the conventional method of preparing the top plate has been associated with the following drawbacks because the nozzle walls and the liquid chamber frames are significantly different in width.

In forming the nozzles by adhering the top plate, principally comprising of silicon, with the heater board, the adhesion is most simply achieved by spraying an adhesive material. This is achieved by spraying, on the surface of the top plate, mist of a resinous adhesive material adjusted in viscosity with diluting liquid and mixed with compressed air. The adhesive comprises a material of high chemical resistance such as polyether amide resin (for example HIMAL supplied by Hitachi Chemical Co.), and is to form a protective film on the inner wall of the nozzle simultaneously with the coating of the adhesive material on the bottom faces of the nozzle walls of the top plate.

However, with the progress of the ink jet printer toward the higher image quality with a nozzle density of 360 dpi or higher, the width of the nozzle wall becomes as small as 40 $\mu$m or even smaller, and, for a nozzle density of 600 dpi, the width of the nozzle wall becomes as small as 10 $\mu$m, which is much smaller than the wall width of the liquid chamber frame. If the adhesive material is spray coated as explained above in such structure, the coated thickness of the adhesive material may fluctuate as shown in FIG. 9, depending on the width of the lateral walls constituting the nozzle and that of the lateral walls constituting the liquid chamber. More specifically the thickness d1 of the adhesive material on the nozzle walls becomes smaller than the thickness d2 of the adhesive on the liquid chamber walls because the latter is larger. For example, in case of coating the adhesive material with a thickness of 10 $\mu$m on the liquid chamber frame of the larger width, the adhesive can only be coated with a thickness of 2 to 5 $\mu$m on the nozzle wall of a width of 10 $\mu$m though this value depends to a certain extent on the viscosity of the adhesive. Also if the thickness of the adhesive is reduced, matching the width of the nozzle wall, the thickness becomes relatively difficult to control and may show fluctuation.

Such fluctuation in the coating thickness of the adhesive results in a fluctuation in the overflowing amount at the adhesion of the substrate. FIG. 12A schematically shows the state of adhesion in case the wall width fluctuates. Since the frame wall of the liquid chamber 2 is wider than the nozzle wall 104, a larger amount of the adhesive 110 overflows into the nozzle 103 at the adhering operation. Such overflowing adhesive 110 deforms the shape inside the nozzle 103, thereby deteriorating the ink flow therein or the ink discharging direction therefrom and, if the adhesive sticks on the heat generating member, the heat generating state for ink discharge may be varied to disable the desired ink discharge.

On the other hand, such fluctuation in the thickness of the adhesive may result in insufficient adhesion on the lateral walls of the nozzle in adhering the top plate and the heater board. Such insufficient adhesion may lead to a crosstalk between the nozzles at the ink discharge or color mixing between the liquid chamber of different colors in case of a color printing head.

For adhering the substrate, the Japanese Patent Application Laid-open No. 60-206657 discloses a technology of forming the nozzle walls and the liquid chamber walls with photosensitive resin on the heater board and adhering the top plate thereon. In order to prevent formation of a closed space at the adhering face between the top plate and the wall, the wall is so formed as to form a space open to the exterior.

In such configuration, however, since the top plate is coated on its entire surface with the adhesive material and is then adhered onto the walls, the surface of the adhesive is exposed in a part of the nozzle. The surface of the adhesive material is difficult to control and may deform the cross-sectional shape of each nozzle, thus eventually affecting the ink flow therein.

SUMMARY OF THE INVENTION

In consideration of the foregoing, the object of the present invention is to solve the above-described drawbacks.

The above-mentioned object can be attained, according to the present invention, by an ink jet printing head in which nozzles and liquid chamber are formed by adhering a first substrate bearing plural walls and a second substrate in mutually opposed manner:

wherein the plural walls of the first substrate, adhered to the second substrate, are arranged by a combination of walls of a substantially same width, and an adhesive layer is provided on the adhesion face of the walls and is integrally adhered to the second substrate.

According to the present invention there is also provided an ink jet printing head comprising a heater board provided with plural heaters for heating ink according to image data, a wall portion constituting lateral walls for defining nozzles for discharging the ink and also constituting lateral walls for defining liquid chamber communicating with the nozzles and lateral walls in a peripheral area of the liquid chamber, and a top plate for covering the upper face of the nozzles and the liquid chamber and constituted by connecting the heater board, the wall portion and the top plate:

wherein the lateral walls constituting the peripheral area of the liquid chamber has an area arranged in a substantially grid pattern with respect to the connecting face.

Furthermore, according to the present invention there is also provided an ink jet printing head comprising a heater board provided with plural heaters for heating ink according to image data, a wall portion constituting lateral walls for defining nozzles for discharging the ink and also constituting lateral walls for defining liquid chamber communicating with the nozzles and lateral walls in a peripheral area of the liquid chamber, and a top plate for covering the upper face of the nozzles and the liquid chamber and constituted by connecting the heater board, the wall portion and the top plate:

wherein the top plate comprises a silicon wafer having a <110> plane on the surface, and the lateral walls defining the nozzles, those defining the liquid chamber and those of the peripheral area are simultaneously processed by anisotropic etching with respect to the top plate.

Furthermore, according to the present invention there is also provided a method for producing an ink jet printing head including a heater board provided with plural heaters for heating ink according to image data, a wall portion constituting lateral walls for defining nozzles for discharging the ink and also constituting lateral walls for defining liquid chamber communicating with the nozzles and lateral walls in a peripheral area of the liquid chamber, and a top plate for covering the upper face of the nozzles and the liquid chamber and constituted by connecting the heater board, the wall portion and the top plate:

wherein the top plate is composed of a silicon wafer having a <110> plane on the surface, and the method comprises a step of simultaneously processing the lateral walls defining the nozzles, those defining the liquid chamber and those of the peripheral area by anisotropic etching with respect to the top plate.

In the head of the present invention, as shown in FIG. 12B, in the adhering portion between the top plate 22 and the heater board 21, the walls are formed with a substantially same width and a space is formed between the walls, so that the coated amount of the adhesive 110 on the adhering face becomes uniform over the entire area. Moreover, the overflowing adhesive 110 has an escaping space and uneven overflowing of the adhesive can be avoided.

Also the walls around the liquid chamber are formed in a grid pattern to increase the positions of adhesion to the substrate, thereby improving the reliability of adhesion.

Furthermore, at the crossing point of the grid pattern, the adhesive can escape in plural directions so that the overflowing amount of the adhesive can be reduced.

Consequently there can be achieved satisfactory adhesion between the top plate and the heater board, little crosstalk between the nozzles at the ink discharge, and no color mixing between the liquid chambers of different colors in case of a color printing head.

The above-described configuration allows to realize a thermal ink jet printing head with a low cost and high stability of manufacture.

DETAILED DESCRIPTION OF THE PREFERRED EMBODIMENTS

[First Embodiment]

In the following there will be explained an embodiment of the present invention with reference to the attached drawings.

Figure 1:
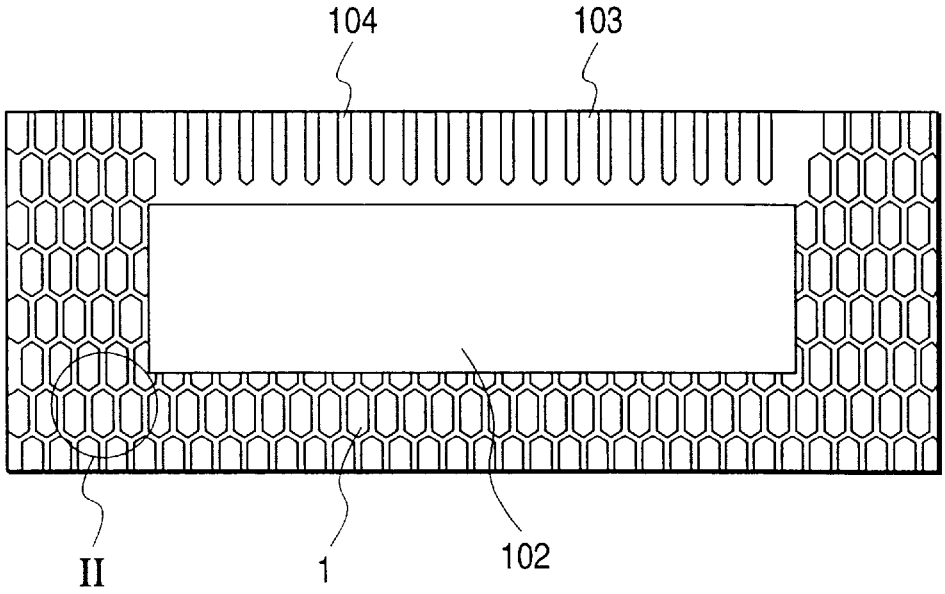
FIG. 1 is a plan view of a top plate constituting a first embodiment of the present invention.
Figure 2:
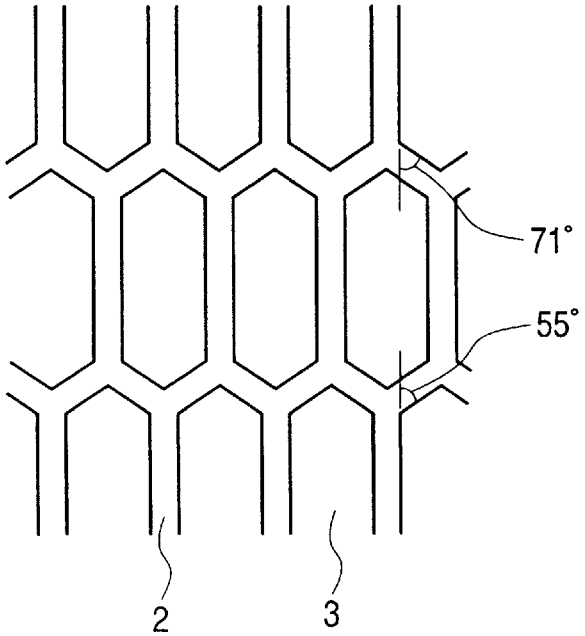
FIG. 2 is a magnified view of liquid chamber frames of the top plate of the first embodiment of the present invention.

FIG. 1 is a schematic view showing a top plate constituting a first embodiment of the present invention, seen from the side of the adhesion face, and FIG. 2 is a partial magnified view of the liquid chamber frames represented by II in FIG. 1.

As shown in these drawings, a first correction pattern 1 is provided with nozzle walls 104 and liquid chamber frame walls 2 formed therearound in order to constitute a liquid chamber 102, and the liquid chamber frame walls have a honeycomb structure having liquid chamber frame apertures 3 and constituted by the combination of the liquid chamber frame walls 2 of a width substantially equal to that of the nozzle walls 104.

The present embodiment provides a head of 360 dpi formed by the nozzle walls 104 of a width of 25 $\mu$m. In case the adhesive has a viscosity of 30 cps, an increase in the wall width by 5 $\mu$m causes an increase in the coated film thickness by 1 $\mu$m. Consequently the width of the liquid chamber frame wall is selected as 35 $\mu$m or less, in order that the difference in the coated thickness does not exceed 2 $\mu$m.

There is employed polyether amide adhesive HIMAL of high chemical resistance (manufactured by Hitachi Chemical Co.). As the fluctuation in the coated thickness of the adhesive is maintained at 2 $\mu$m or less, the top plate could be adhered on the entire area to the heater board by applying a pressure of 300 g/mm$^2$ for 1 hour at 250° C. after mutual alignment.

The pattern of the liquid chamber frames of the present invention can be simultaneously formed with the patterning of the nozzle walls, so that the top plate stable for adhesion can be obtained without an increase in the manufacturing cost, in comparison with the conventional process for producing the top plate shown in FIGS. 7A to 7H.

In the liquid chamber frame pattern of the present embodiment, the nozzle walls and the liquid chamber walls are simultaneously formed by anisotropic etching as explained in the foregoing, so that, among the liquid chamber frames, the walls along the direction of the nozzles are formed parallel to the nozzles. Also the walls transversal to the nozzles are not at an angle of 90° but at 71° and 55° thereto.

Figure 3:
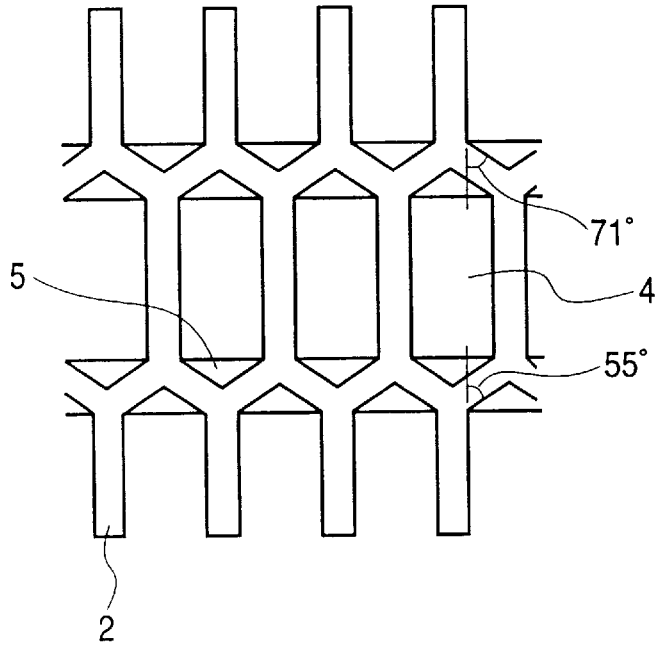
FIG. 3 is a view showing a mask pattern realizing the first embodiment of the present invention.

As the anisotropic etching utilizes the lower etching rate of the <111> plane, the obtained shape depends strongly on the direction of the <111> plane, and the above-mentioned angles 71° and 55° are determined from the crystalline planes of silicon. Consequently the mask 4 for patterning the liquid chamber frames may have apertures along the crystalline direction of the <111> plane, but the liquid chamber frames may also be formed by utilizing mask apertures consisting of an array of rectangles as shown in FIG. 3 and executing overetching until the etching is stopped by the <111> plane as indicated by a numeral 5 in FIG. 3.

In the top plate of the present embodiment, as explained in the foregoing, the liquid chamber frames are patterned by anisotropic etching simultaneously with the formation of the nozzle walls and the wall width of the liquid chamber frames is selected not exceeding the nozzle wall width +10 $\mu$m, so that it is rendered possible to coat the adhesive material with a uniform thickness and to suppress the overflowing of the adhesive material at the adhesion under pressure, without complicating the process for producing the top plate. Consequently there can be obtained a top plate showing satisfactory adhesion to the heater board and excellent in the stability of manufacture.

Also the honeycomb-shaped pattern are expected to improve the strength of the walls and to stabilize the adhesion state with the heater board, since the crossing points of the walls are not positioned in line but are distributed in well-balanced manner. Furthermore, as the adhesion material spreads in three directions at the crossing point, it is possible to satisfactorily spread the adhesive material and to suppress the overflowing thereof into the liquid chamber or into the nozzles.

The effect of the present invention can still be attained in case the difference in the width between the liquid chamber frames and the nozzle walls is selected as not exceeding 20

μm, depending on the coating condition of the adhesive material and the adhering condition with the heater board, but a difference not exceeding 10 μm is preferred in consideration of the ease of manufacture. More specifically, with respect to the width of the nozzle walls, the width of the walls of the liquid chamber frames is preferably within a range of 0.2 to 1.8 times, more preferably within a range of 0.6 to 1.4 times.

Figure 6:
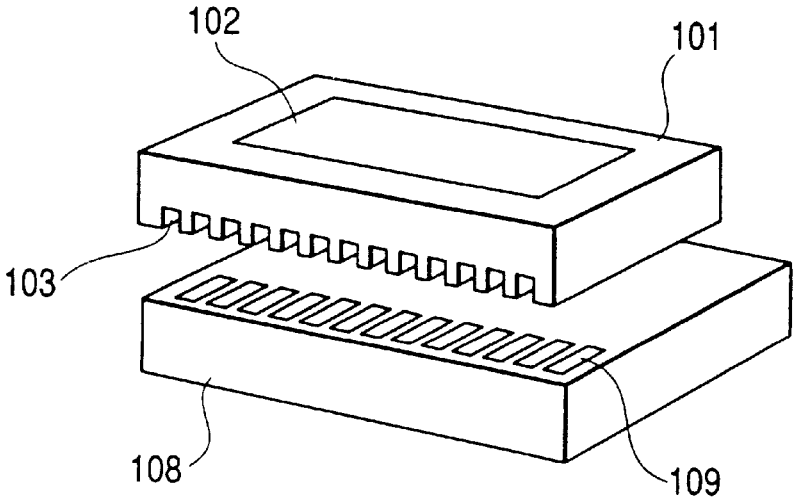
FIG. 6 PRIOR ART
FIG. 6 is a perspective view showing the adhesion state of the top plate and the heater board.
Figure 7A:
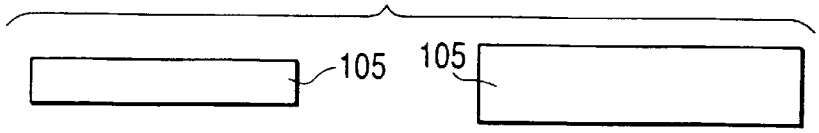
FIG. 7A PRIOR ART
FIGS. 7A, 7B, 7C, 7D, 7E, 7F, 7G and 7H are views showing steps of preparing the top plate.
Figure 7B:
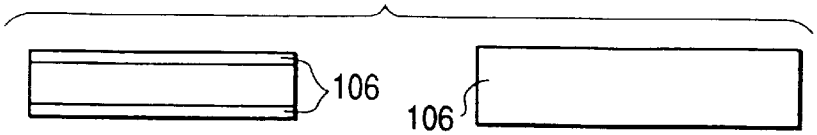
FIG. 7B PRIOR ART
Figure 7C:
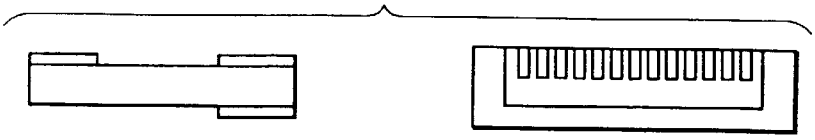
FIG. 7C PRIOR ART
Figure 7D:
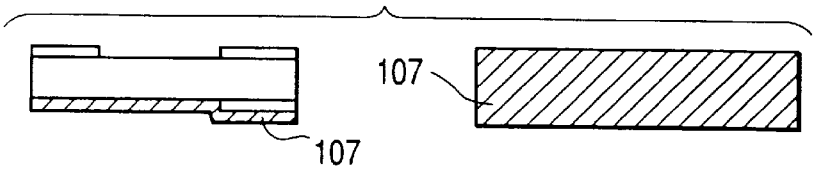
FIG. 7D PRIOR ART
Figure 7E:
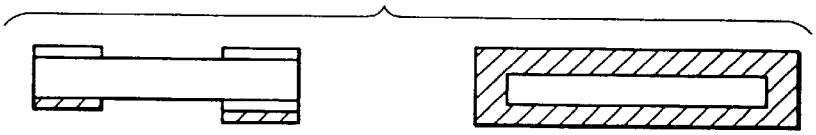
FIG. 7E PRIOR ART
Figure 7F:
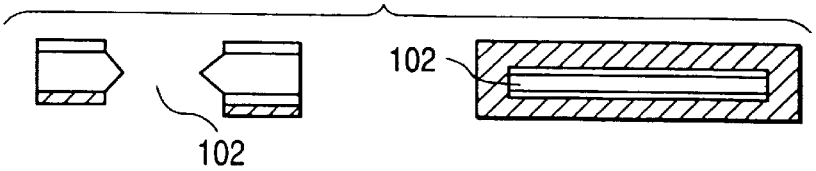
FIG. 7F PRIOR ART
Figure 7G:
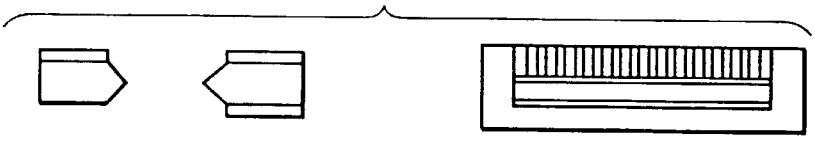
FIG. 7G PRIOR ART
Figure 7H:
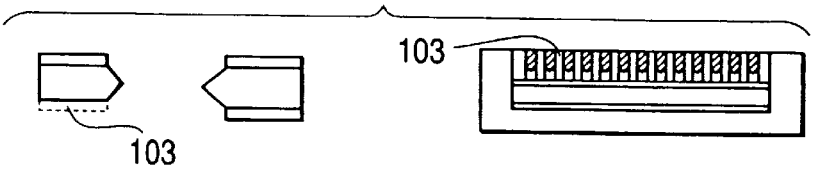
FIG. 7H PRIOR ART
Figure 8:
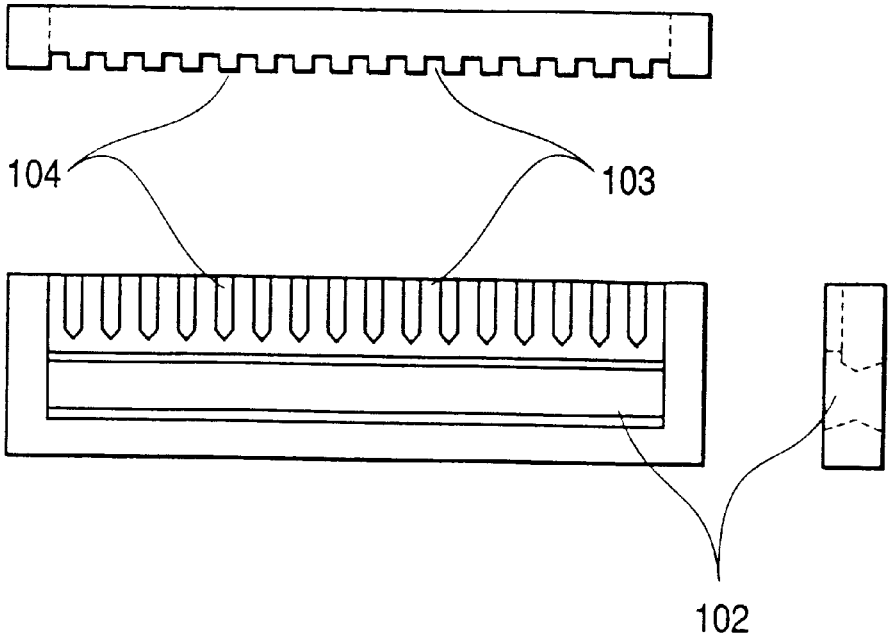
FIG. 8 PRIOR ART
FIG. 8 is a cross-sectional view of a top plate.
Figure 9:
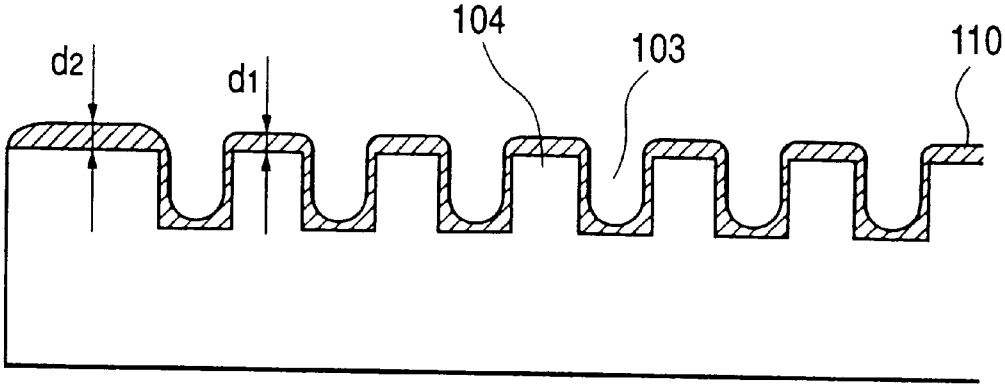
FIG. 9 PRIOR ART
FIG. 9 is a view showing a conventional top plate in a state coated with adhesive material.

The top plate of the present invention is not limited to the configuration shown in FIG. 6, and the present invention is also effective, for example, in case valves are provided on the heater board in order to improve the efficiency of ink discharge. In the present invention, since the nozzle walls are vertical, they do not hinder the function of the valves and a faster operation can be realized.

[Second Embodiment]

Figure 4:
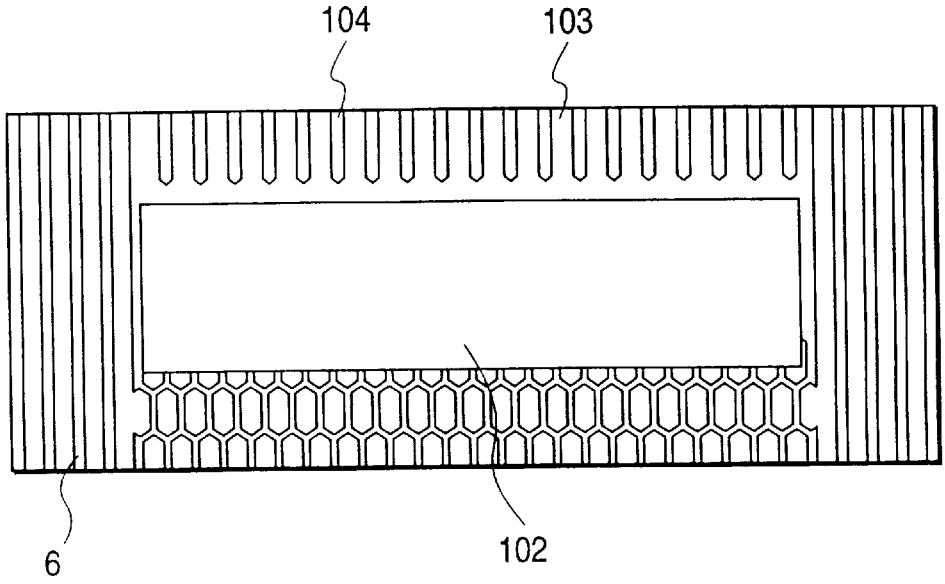
FIG. 4 is a plan view showing liquid chamber frames in a second embodiment of the present invention.

In the following there will be explained a second embodiment of the nozzle member of the present invention, with reference to FIG. 4. This embodiment is different from the first embodiment in that an area not having penetrating holes to the liquid chamber along the nozzle direction is given, instead of the honeycomb-shaped pattern, a second correction pattern 6, consisting of an oblong stripe pattern connected to the front and rear sides of the top plate.

Such configuration is effective in case the coated state of the adhesive material may become uneven because, when the nozzles are formed by anisotropic etching, the walls transveral to the nozzles become zigzag shaped and are therefore not equivalent to the walls along the nozzles and because such zigzag-shaped walls are not perpendicular to the surface as the <111> plane is not perpendicular thereto. More specifically, at both ends of the top plate or in a frame portion separating the liquid chambers of different colors, there may be assumed the second correction pattern 6 having the oblong walls along the nozzles, thereby realizing walls identical with the nozzle walls and obtaining uniform coating condition for the adhesive material. It is also possible to form the walls along the nozzle direction behind the liquid chamber and, if the coating of the adhesive material becomes uneven, to add liquid adhesive after the adhesion of the top plate and the heater board thereby forming a completely closed structure.

[Third Embodiment]

Figure 5:
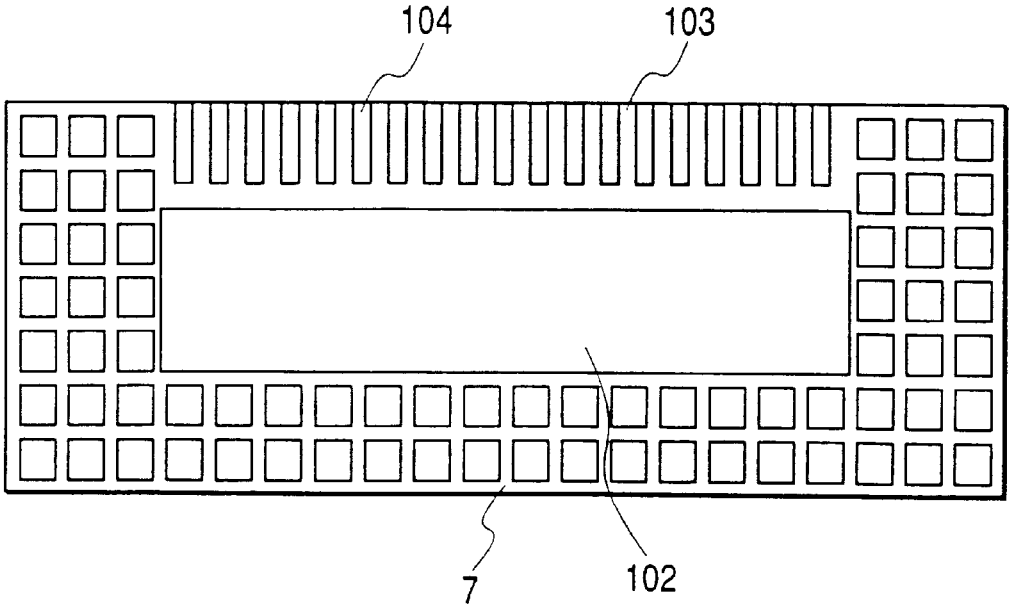
FIG. 5 is a plan view showing liquid chamber frames in a third embodiment of the present invention.

A third embodiment of the nozzle member of the present invention will be explained with reference to FIG. 5. In this embodiment, the nozzles are formed by dry etching instead of anisotropic wet etching of silicon. In this case, a film of a metal such as aluminum is formed and patterned prior to the formation of the silicon nitride film in a step shown in FIG. 7D, and, in a step shown in FIG. 7H, silicon is deep etched for example by ion-coupled plasma etching, utilizing thus obtained metal mask, instead of the anisotropic etching. In this process, the etching can be achieved according to the mask pattern, without overetching along the crystalline plane as in the case of anisotropic etching, so that there can be obtained a third correction pattern 7 consisting of liquid chamber frames of a simple grid pattern as shown in FIG. 5. Therefore the top plate intended in the present invention can be obtained by simultaneous formation of the nozzles and the walls of the grid pattern of a width substantially same as that of the nozzle walls.

[Fourth Embodiment]

Figure 10:
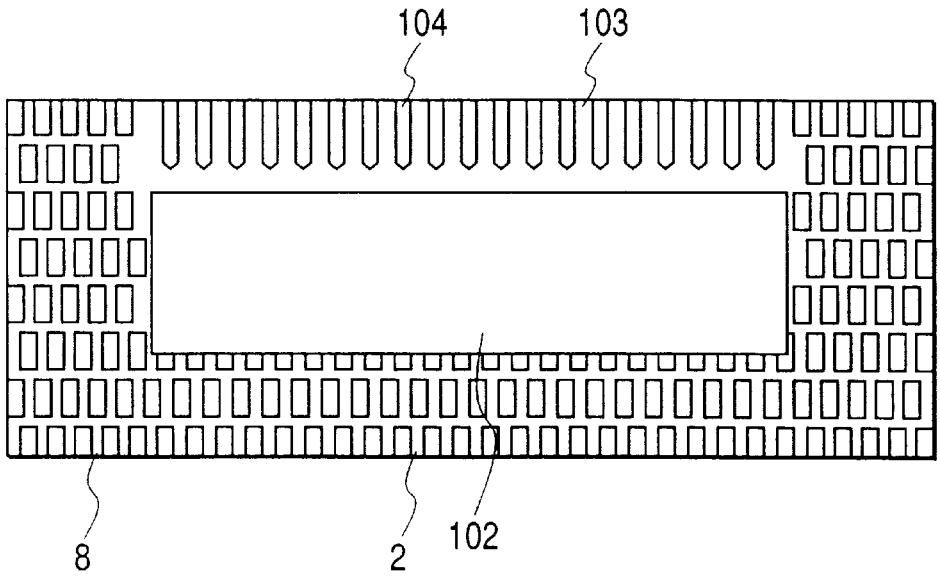
FIG. 10 is a plan view showing liquid chamber frames in a fourth embodiment of the present invention.

A fourth embodiment of the nozzle member of the present invention will be explained with reference to FIG. 10.

A fourth correction pattern 8 of the present embodiment is different from the third embodiment in that the grid rectangles are arranged in staggered manner.

For increasing the adhesion strength, it is important to increase the adhesion area and, therefore, to arrange a larger number of walls in a grid pattern. By arranging such grid patterns in a staggered manner, it is possible to increase the structural strength of the walls. Also, as every lattice point consists of three walls, the flow of the adhesive material after adhesion becomes uniform. The staggered grid wall arrangement of the present embodiment is advantageous for improving the adhesion strength and structural strength, obtaining uniform flow of the adhesive material and suppressing the overflow of the adhesive material into the nozzles and the liquid chamber.

[Fifth Embodiment]

Figure 11:
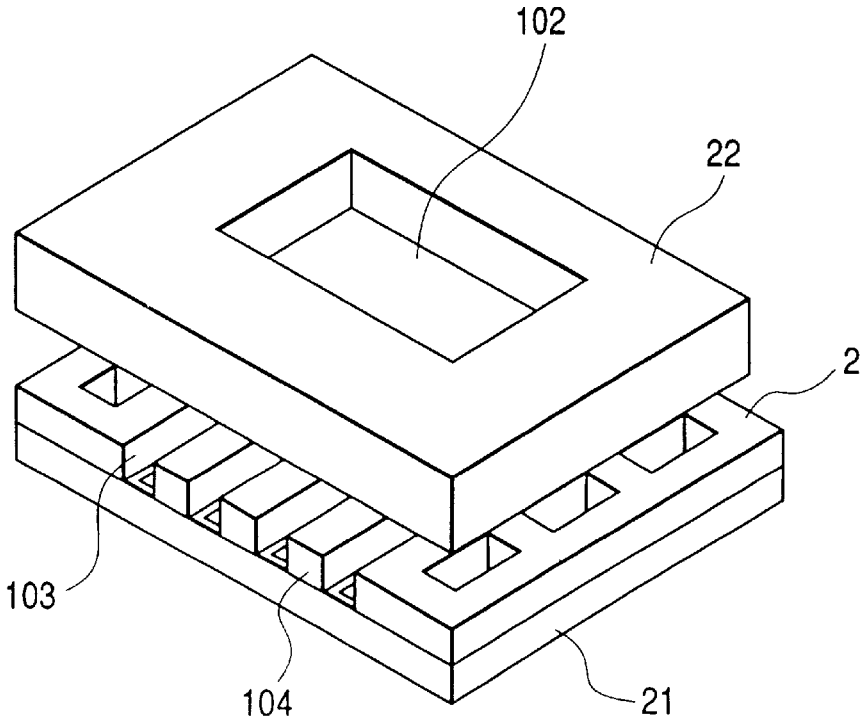
FIG. 11 is a perspective view showing a 5th embodiment of the present invention.
Figure 12A:
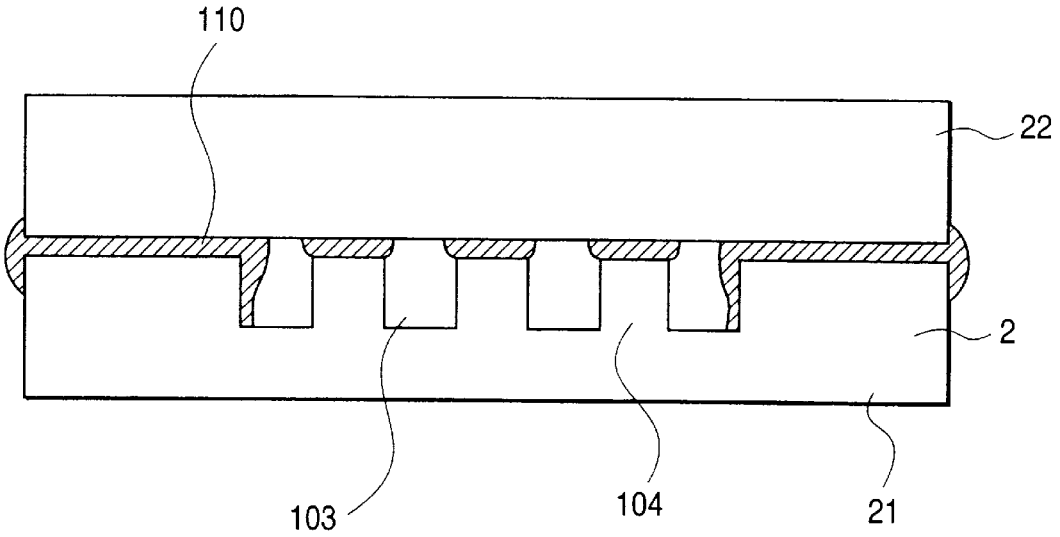
FIG. 12A is a schematic view showing the overflowing state of adhesive material.
Figure 12B:
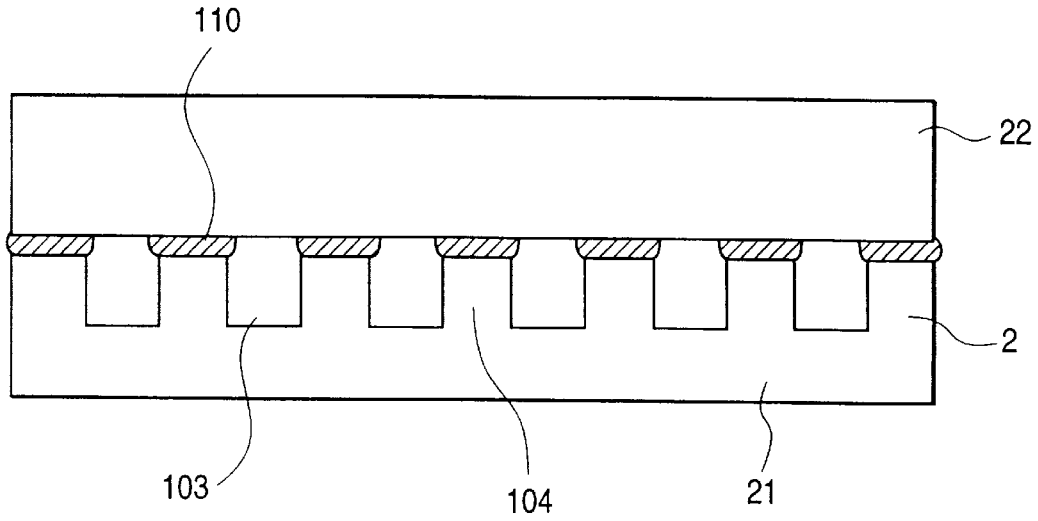
FIG. 12B is a schematic view showing the state of the adhesive material in a configuration of the present invention.

A fifth embodiment of the nozzle member of the present invention will be explained with reference to FIG. 11.

The present embodiment is different from the first, second, third or forth embodiment in that the nozzle walls 104 and the liquid chamber frame walls 2 are formed on the heater board 21.

The nozzles are formed by adhering the heater board 21 and the top plate 22, but it is difficult to coat the adhesive material with a uniform thickness on the top plate because of the large surface area thereof.

For this reason it is necessary to apply the adhesive material on the heater board, but the deposition of the adhesive onto the heat generating members has to be avoided, so that the transfer method is considered effective. However, also in case of the transfer method, the transferred amount onto the walls fluctuates depending on the wall width, as in the case of spray coating.

However, based on the configuration defined in the present invention, the transferred amount becomes uniform since the adhesion parts between the top plate and the heater board are constituted by the combination of walls of a substantially same width.

Also because a space is present between the walls, it is rendered possible to prevent uneven overflowing of the adhesive material at the adhering operation, thereby suppressing the detrimental influence in the nozzles 103 and the liquid chamber 102.

In this manner, the present invention is also effective in case the walls are formed on the heater board.

The walls formed on the heater board may have any of the configurations shown in the first to fourth embodiments, but the staggered grid wall pattern disclosed in the fourth embodiment is preferred in consideration of the ease and stability of manufacture and suppression of adhesive overflowing.

In the foregoing embodiments, the walls are formed in one substrate only and are adhered to the other planar substrate, but it is naturally possible also to form walls of mutually matching forms on the adhesion faces of both substrates and to mutually adhere such substrates. Also in such case, the adhesion can be achieved by applying the adhesive material on the walls of either substrate.

According to the present invention, as explained in the foregoing, in preparing the top plate of the ink jet printing head with silicon, the liquid chamber frames are constituted by walls of a width similar to that of the nozzle walls and are simultaneously formed with such nozzle walls, thereby providing the printing head showing satisfactory adhesion between the top plate and the heater board and excellent in stability of manufacture, without complicating the process for producing the top plate.

What is claimed is:

1. An ink jet printing head comprising:

a plurality of nozzles; and a liquid chamber, wherein said nozzles and said liquid chamber are formed by adhering a first substrate on which a plurality of walls are formed to a second substrate in mutually opposed manner; and wherein the plural walls of said first substrate are successively arranged, and each of the walls has a substantially same width, over an area outside of an area in which are located said nozzles and said liquid chamber.

2. An ink jet printing head according to claim 1, wherein said second substrate is provided on the adhering face thereof with plural walls in positions corresponding to the plural walls provided on said first substrate.

3. An ink jet printing head according to claim 2, wherein the walls provided on each of said first and second substrates have a lattice pattern.

4. An ink jet printing head according to claim 3, wherein said lattice pattern is a staggered grid pattern.

5. An ink jet printing head according to claim 3, wherein said lattice pattern is a honeycomb pattern.

6. An ink jet printing head according to claim 1, wherein said first substrate is a top plate having a plurality of grooves therein and said second substrate is a heater board having a plurality of heaters.

7. An ink jet printing head according to claim 6, wherein said top plate is made from a silicon wafer having a <110> plane on its surface.

8. An ink jet printing head according to claim 7, wherein an adhesion surface of said top plate and said heater board is simultaneously processed by anisotropic etching.

9. An ink jet printing head according to claim 7, wherein an adhesion surface of said top plate and said heater board is simultaneously processed by plasma etching.

10. An ink jet printing head according to claim 1, wherein said first substrate is a heater board having a plurality of heaters for heating ink according to image data and said second substrate is a top plate.

11. An ink jet printing head according to claim 1, wherein the walls are arranged in a lattice pattern.

12. An ink jet printing head according to claim 11, wherein said lattice pattern is a staggered grid pattern.

13.An ink jet printing head according to claim 11, wherein said lattice pattern is a honeycomb pattern.

14. A method for producing an ink jet printing head according to claim 1, comprising a step of processing the adhesion surface of said first substrate and said second substrate by anisotropic etching.

15. A method according to claim 14, wherein said first substrate is a top plate having a plurality of grooves and said second substrate is a heater board having a plurality of heaters.

16. A method according to claim 15, further comprising the step of applying a solution of an adhesive material so that said top plate and said heater board are mutually adhered.

17. A method for producing an ink jet printing head according to claim 1, comprising a step of processing an adhesion surface of said first substrate and said second substrate by plasma etching.

18. A method according to claim 17, wherein said first substrate is a top plate having a plurality of grooves and said second substrate is a heater board having a plurality of heaters.

19. A method according to claim 18, further comprising the step of applying a solution of an adhesive material so that said top plate and said heater board are mutually adhered.

20. An ink jet printing head comprising:

a heater board having a plurality of heaters for heating an ink according to image data;

a wall portion constituting a plurality of lateral walls defining a plurality of nozzles for discharging said ink, the lateral walls also defining a liquid chamber communicating with the nozzles, and some of the lateral walls constituting a peripheral area of the liquid chamber; and a top plate covering an upper surface of said nozzles and said liquid chamber;

wherein said head is constituted by mutually connecting said heater board, said wall portion and said top plate, and wherein those said lateral walls constituting said peripheral area of the liquid chamber are constituted by successively arranging the walls over a whole area out of an area to define said nozzles and said liquid chamber, and have an area arranged in a substantially lattice pattern relative to a connecting plane, an adhesive laver being formed on an adhering face of said walls.

21. An ink jet printing head according to claim 20, wherein a width of the lateral walls of said liquid chamber and a width of the lateral walls in the peripheral area of said liquid chamber is between 0.2–1.8 times the width of the lateral walls of said nozzles.

22. An ink jet printing head according to claim 21, wherein said width of the lateral walls of the liquid chamber and the lateral walls in the peripheral area is between 0.6 to 1.4 times the width of the lateral walls of said nozzles.

23. An ink jet printing head according to claim 20, wherein said wall portion is formed on said top plate, and an adhesive layer is formed on said wall portion on an adhesion surface thereof with said heater board and is adhered to said heater board.

24. An ink jet printing head according to claim 23, wherein said top plate is a silicon wafer having a <110> plane on its surface, and the lateral walls of said nozzles, those of said liquid chamber and those in the peripheral area of said liquid chamber are simultaneously processed by anisotropic etching.

25. An ink jet printing head according to claim 23, wherein said top plate is a silicon wafer having a <110> plane on its surface, and the lateral walls of said nozzles, those of said liquid chamber and those in the peripheral area of said liquid chamber are simultaneously processed by plasma etching.

26. An ink jet printing head according to claim 20, wherein said wall portion is formed on said heater board, and an adhesive layer is formed on said wall portion on an adhesion surface thereof with said top plate and is adhered to said top plate.

27. A method for producing an ink jet printing head having a heater board having a plurality of heaters for heating an ink according to image data, a wall portion constituting a plurality of lateral walls defining a plurality of nozzles for discharging said ink, the lateral walls also defining a liquid chamber communicating with the nozzles, and some of the lateral walls constituting a peripheral area of the liquid chamber, and a top plate covering an upper surface of said nozzles and said liquid chamber, wherein said head is constituted by mutually connecting said heater board, said wall portion and said top plate, comprising the steps of:

forming an adhesive layer on said wall portion on an adhesion surface thereof with said heater board;

connecting said adhesive layer with said heater board; and simultaneously forming the lateral walls of said nozzles, those of said liquid chamber and those in the peripheral area of said liquid chamber by anisotropic etching relative to said top plate, wherein said top plate is a silicon wafer having a <110> plane on its surface, and wherein a lateral wall of said peripheral area of the liquid chamber is arranged by a succession of plural walls to a whole area out of an area to be said nozzles and the liquid chamber.

28. A method for producing an ink jet printing head having a heater board having a plurality of heaters for heating an ink according to image data, a wall portion constituting a plurality of lateral walls defining a plurality of nozzles for discharging said ink, the lateral walls also defining a liquid chamber communicating with the nozzles, and some of the lateral walls constituting a peripheral area of the liquid chamber; and a top plate covering an upper surface of said nozzles and said liquid chamber, wherein said head is constituted by mutually connecting said heater board, said wall portion and said top plate, comprising the steps of:

forming an adhesive layer on said wall portion on an adhesion surface thereof with said heater board;

connecting said adhesive layer with said heater board; and simultaneously forming the lateral walls of said nozzles, those of said liquid chamber and those in the peripheral area of said liquid chamber by plasma etching relative to said top plate, wherein said top plate is a silicon wafer having a <110> plane on its surface, and wherein a lateral wall of said peripheral area of the liquid chamber is arranged by a succession of plural walls to a whole area out of an area to be said nozzles and the liquid chamber.

* * * * *

UNITED STATES PATENT AND TRADEMARK OFFICE

CERTIFICATE OF CORRECTION

PATENT NO. : 6,254,215 B1
DATED : July 3, 2001
INVENTOR(S) : Tomoyuki Hiroki et al.

It is certified that error appears in the above-identified patent and that said Letters Patent is hereby corrected as shown below:

Title page,
Item [56], References Cited, FOREIGN PATENT DOCUMENTS, "02187351" should read -- 2-187351 --.

Column 3,
Line 4, "comprising" should read -- composed --.

Column 6,
Line 56, "are" should read -- is --.

Column 9,
Line 5, "manner;" should read -- manner, --; and
Line 40, "13.An" should read -- 13. An --.

Column 11,
Line 12, "a whole" should read -- form a whole --.

Column 12,
Line 17, "a whole" should read -- form a whole --.

Signed and Sealed this

Ninth Day of April, 2002

*Attest:*

*Attesting Officer*

JAMES E. ROGAN
*Director of the United States Patent and Trademark Office*